United States Patent [19]

Howell

[11] 3,996,712

[45] Dec. 14, 1976

[54] METAL BUILDING

[75] Inventor: John D. Howell, Burlingame, Calif.

[73] Assignee: Aluminum Plumbing Fixture Corporation, Burlingame, Calif.

[22] Filed: June 19, 1975

[21] Appl. No.: 588,215

[52] U.S. Cl. ..... 52/241; 52/300; 52/481

[51] Int. Cl.[2] ..... E04H 1/00; E04B 2/00; E04B 2/32

[58] Field of Search ..... 52/241, 242, 243, 275, 52/574, 588, 264, 300, 481

[56] References Cited

UNITED STATES PATENTS

| | | | |
|---|---|---|---|
| 3,289,375 | 12/1966 | Cline | 52/574 |
| 3,381,438 | 5/1968 | Bohnsack | 52/241 |
| 3,623,290 | 11/1971 | Downing | 52/481 |

FOREIGN PATENTS OR APPLICATIONS

| | | | |
|---|---|---|---|
| 190,980 | 7/1957 | Austria | 52/275 |

*Primary Examiner*—Price C. Faw, Jr.
*Assistant Examiner*—William Randolph
*Attorney, Agent, or Firm*—Robert G. Slick

[57] ABSTRACT

A double-walled metal building is provided wherein the exterior walls snap into place. The exterior walls are formed of panels which have inturned lips at each side which fit into mating slots and the bottom is provided with clips to hold the bottom of the panel in place. The panel is secured by a top cap which covers the tops of both the interior and the exterior walls, locking the structure together. The only fastening elements which must be installed by workmen are self-tapping screws holding the top cap in place.

2 Claims, 4 Drawing Figures

METAL BUILDING

SUMMARY OF THE INVENTION

Double-walled metal buildings are extensively used for many purposes such as, for example, the toilets in public parks. In the past, such buildings have been assembled by means of welding, riveting, self-tapping screws or the like so that a large amount of hand labor is involved in erecting the building. Further, if it is desired to move the building, the disassembly and reassembly operations are quite complicated.

In accordance with the present invention, a building structure is provided wherein the outer walls merely snap into place. The outer walls consist of a series of panels with inturned side flanges which fit into slots in the structural members of the building. The bottom of the panels are provided with clips which fit over a sill while the top of the panel is held in place by means of a top cap, so when this top cap is locked into place, the panels are held in position merely by this one member. Thus, the use of bolts and screws to assemble the building is minimized.

In accordance with the preferred embodiment of the invention, the top cap also serves as a window sill to hold a wire guard, sash or louver in position.

Various features and advantages of the invention will be brought out in the description which follows.

DESCRIPTION OF THE PREFERRED EMBODIMENTS

Figure 1:
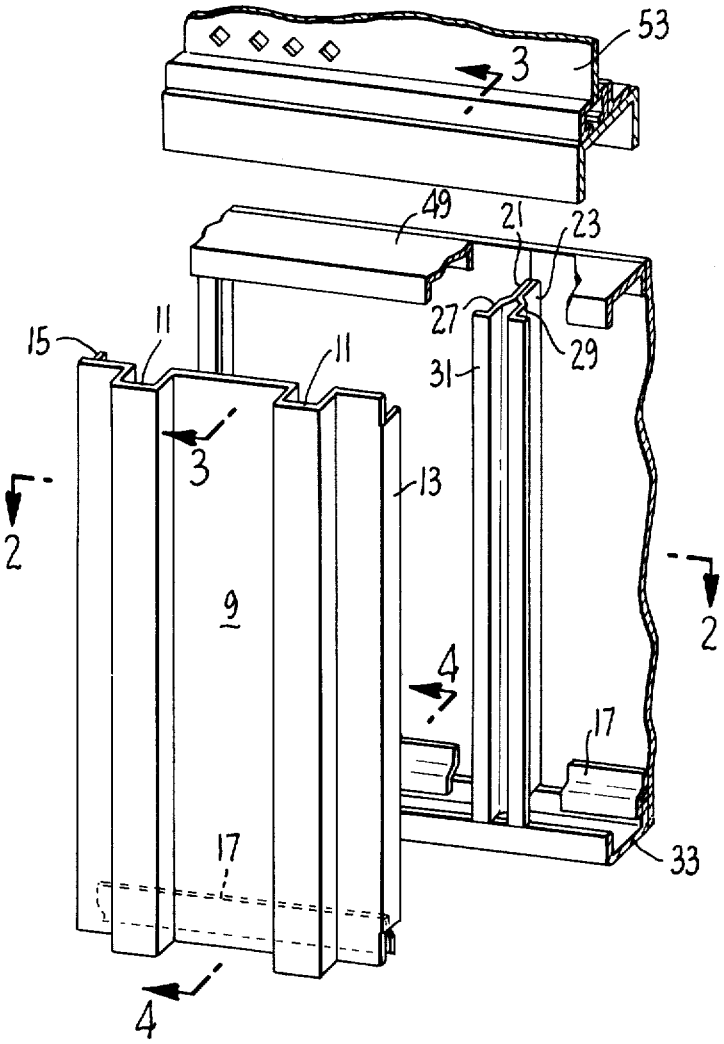
FIG. 1 is a perspective, exploded view of a portion of a building embodying the present invention.
Figure 3:
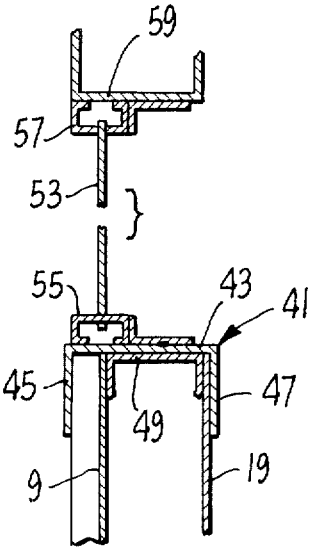
FIG. 3 is a section on the line 3—3 of FIG. 1 again showing the parts in assembled relationship.

In accordance with the present invention, a metal building is assembled having double walls, namely an inner wall 5 and an outer wall 7. The outer wall 7 is assembled from a plurality of panels 9 which may be of generally flat configuration or which preferably have corrugations as at 11. At each edge of the panel, inturned flanges 13 and 15 are provided. At the bottom of the panel, a continuous metal clip 17 is provided which has an opening which extends downwardly on the inside of the panel.

Figure 2:
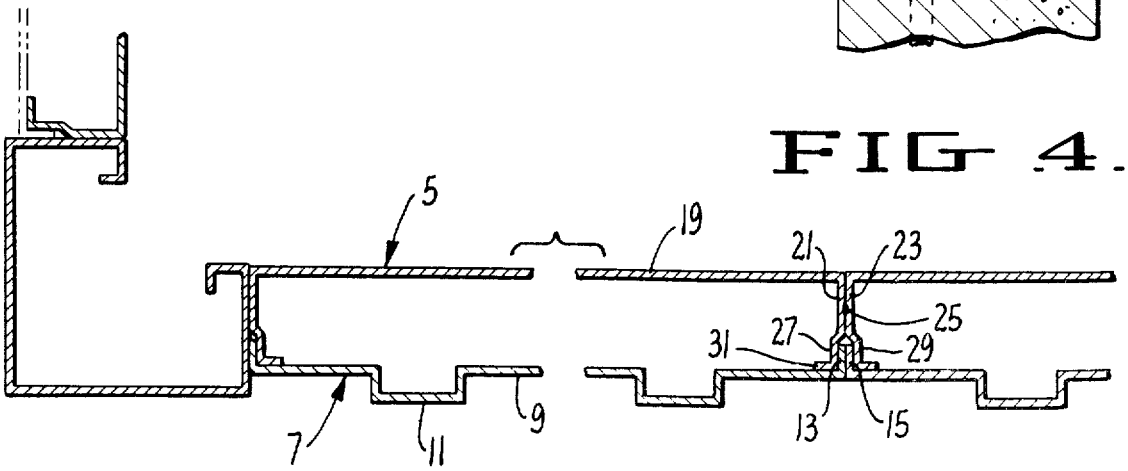
FIG. 2 is a section on the line 2—2 of FIG. 1 but showing the parts in assembled relationship.

The interior wall generally designated 5 is preferably made of a series of panels 19 and these are assembled in known fashion by welding, riveting, sheet metal screws or the like. Attached to the inner panels, either by welding or formed integrally therewith are projections 21 which extend outward from the panel and are fastened to the next adjacent projection 23 by suitable means such as bolts 25. The outer edges of these projections are spread out as at 27 and 29 to provide a central U-shaped slot so that the inturned edges 13 and 15 of two adjacent front panels will fit snugly within the slot as is best shown in FIG. 2. Also, the outer edges are preferably turned over at a right angle as at 31 to provide support for the front panel.

Figure 4:
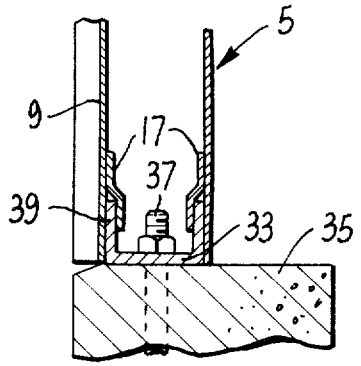
FIG. 4 is a section on the line 4—4 of FIG. 1 showing the parts assembled.

The bottoms of the panel are assembled on a sill as is best seen in FIG. 4. The sill 33 is fastened to a foundation 35 by suitable means such as bolt 37. Sill 33 has an upstanding lip 39 over which the clip 17 fits. Sill 33 would normally also be provided with means for fastening the interior wall but this forms no part of the present invention.

At the top of the panel a sill is provided which may also serve to hold a window screen or the like. The sill is generally designated 41 and has a flat upper portion 43 with downward extending flanges 45 and 47. A stringer 49 is normally provided which fits between the front panels and the rear panels of the structure. Part 49 is spot welded to part 41 at flat portion 43.

In the preferred embodiment of the invention, sill 41 also serves as a lower sill to hold a screen 53 of perforated metal or other suitable material. Sill 41 is provided with a bracket 55 into which the screen 53 fits while the top of the screen is attached to a similar bracket 57 which is retained at the top of a window opening by an upper sill 59.

In order to assemble a building in accordance with the present invention, the interior walls are first erected in known manner and held in place by suitable means such as welding, self-tapping bolts, screws or the like. The assembly of the outer panel is now very simple and requires a minimum amount of labor. The panels 9 are merely placed slightly above the structure and the clips 17 passed over the upwardly extending lip 39 of the sill member. The flanges 13 and 15 are now pressed into the grooves and the top sill 43 put into place and held by suitable means such as selftapping screws. Thus, the only real mechanical operation which is necessary in erecting the outer walls of the building is to press the panels into place and then place the top cap thereon. The clips 17 hold the panels from outward movement near the bottom, the side flanges 13 and 15 effectively prevent sideways motion, while the top cap 43 prevents motion outwardly from the top as well as upwardly. Thus the panel is effectively held into position with a minimum of labor to attach the panels to the structure.

If it is desired to move the building, the panels can be easily removed.

I claim:

1. A metal building construction comprising in combination:

a. an interior building wall having outwardly extending members at spaced intervals, said outwardly extending members having a planar U-shaped vertical slot at the terminal ends, b. a lower sill, said lower sill having an upwardly extending lip at substantially the position occupied by a front panel of the building, c. a plurality of panels, each of said panels having a bottom edge, said bottom edge being provided with at least one clip which clips over said lip, d. each of said panels having planar edge flanges on both edges extending inwardly, said edge members being adapted to sit snugly into said U-shaped slots, e. a top cap having front and back downwardly extending lips, whereby the back lip will extend over the interior wall of the building and the front lip will extend over the exterior wall of the building, f. means for holding said top cap in place on said building structure, and g. said top cap and said clip constituting the sole means of holding said panels against horizontal movement.

2. The structure of claim 1 wherein the top cap serves as a lower sill for a window extending over the building wall.

* * * * *